US007048045B2

(12) United States Patent
Vossler

(10) Patent No.: US 7,048,045 B2
(45) Date of Patent: May 23, 2006

(54) GAS LIFT APPARATUS FOR A WELL

(75) Inventor: Vernon Vossler, Redcliff (CA)

(73) Assignee: Petro-Canada, Calgary (CA)

( * ) Notice: Subject to any disclaimer, the term of this patent is extended or adjusted under 35 U.S.C. 154(b) by 143 days.

(21) Appl. No.: 10/761,779

(22) Filed: Jan. 21, 2004

(65) Prior Publication Data

US 2005/0155756 A1 Jul. 21, 2005

(51) Int. Cl.
*E21B 43/16* (2006.01)

(52) U.S. Cl. ..... 166/63; 166/105.6; 166/106

(58) Field of Classification Search ..... 166/372, 166/63, 105.5, 105.6, 106; 417/109
See application file for complete search history.

(56) References Cited

U.S. PATENT DOCUMENTS 1,175,599 A 3/1916 Butler
1,238,165 A 8/1917 Lynn
1,374,952 A * 4/1921 Rogers ..... 417/109
1,412,920 A 4/1922 Carson
1,414,402 A 5/1922 Friedman et al.
1,501,536 A 7/1924 Friedman et al.
1,865,873 A * 7/1932 Miller ..... 417/109
3,090,316 A * 5/1963 Montgomery ..... 166/372
4,708,595 A * 11/1987 Maloney et al. ..... 417/109
6,026,904 A * 2/2000 Burd et al. ..... 166/313
6,138,763 A * 10/2000 Beauquin ..... 166/372

* cited by examiner

*Primary Examiner*—Kenneth Thompson
(74) *Attorney, Agent, or Firm*—Marsh Fischmann & Breyfogle LLP

(57) ABSTRACT

In a flowing gas well having concentric production casing and tubing strings:

a funnel is mounted to the bottom end of the tubing string;

a packer divides the annulus into upper and lower portions;

a tube is provided having an inlet, which communicates with the lower portion of the annulus, immediately beneath the packer, and an upwardly directed restrictive outlet which communicates with the passageway extending through the funnel;

so that gas under pressure moves through the tube from the annulus lower portion, is jetted into the production bore (formed by the funnel passageway and tubing string bore) and assists in gas lifting produced water to ground surface.

12 Claims, 2 Drawing Sheets

GAS LIFT APPARATUS FOR A WELL

FIELD OF THE INVENTION

The present invention relates to apparatus for use in a flowing natural gas well to assist with gas lifting water, co-produced with the gas, to ground surface.

BACKGROUND OF THE INVENTION

The present invention was conceived to address problems affecting natural gas recovery from wells in the southern gas fields of Saskatchewan. The problems will be described in connection with those wells. However it will be appreciated that the invention may find application in other fields and wells.

The subterranean gas producing reservoir or formation involved is at shallow depth (about 340–695 feet). The wells are flowing wells. In a typical case, each well is cased with a string of 4" tubular production casing to total depth and is perforated across a production interval of the formation. A string of ¾" to 1-¼" tubular continuous coil tubing extends down to the perforations. Some of the tubing strings are equipped with a packer. The packer seals against the casing to sub-divide the annulus between the two strings at a point above but close to the perforations.

In most wells, the producing formation produces salt water and particulate solids along with the natural gas.

The water is lifted by the gas up through the bore of the tubing string to ground surface in the form of alternating slugs of gas and water, under the impetus of formation pressure. However, slugs of water may settle in the tubing string and coalesce to form a column. This column may have a hydrostatic head that equals or exceeds the bottom hole pressure. In this event, the well will 'die'. That is, additional fluid will be unable to enter the casing bore and fluid production from the well will cease.

The entry of particulate solids, such as sand, into the casing bore creates a different problem. The solids may settle in the annulus and build up at the base of the well until they cover the perforations, thereby interfering with incoming fluid flow from the formation.

It therefore is desirable to provide means for enhancing gas lift in the tubing string, with the aim of reducing settling and coalescence of the water slugs being produced.

It preferably also is desirable to enhance the turbulence of flow at the base of the casing bore, with the aim of reducing settling and build up of solids.

SUMMARY OF THE INVENTION

In accordance with one embodiment of the invention, a flowing gas well is provided, having a string of production casing and a string of production tubing. The casing string is perforated across a production interval of the producing formation.

A funnel, preferably conical in configuration, is connected with the lower end of the tubing string.

The funnel widens downwardly and outwardly to approach the inside surface of the casing string and combines therewith to form a narrow gap for connecting the lower end of the bore of the casing string with a lower portion of the annulus described hereinbelow. The gap is preferably annular in configuration. The internal, longitudinal passageway of the funnel and the longitudinal bore of the tubing string combine to form an open-bottomed production bore.

A packer is mounted on the tubing string above the funnel. The packer functions to seal against the casing string to isolate a lower portion of the annulus beneath the packer from the upper portion of the annulus above the packer.

The outside surface of the funnel, the outside surface of the tubing string beneath the packer, the base of the packer and the inside surface of the casing string combine to form the lower portion of the annulus. The annular gap provides communication between the bottom of the well bore and the annulus lower portion.

The tubing string, packer and funnel combine to form a structural unit.

Conduit means, such as a tube, supported by the structural unit, connects the lower portion of the annulus with the production bore. More particularly, the tube has an inlet that communicates with the upper end of the lower portion of the annulus and an outlet that communicates with the production bore. Preferably the outlet is an upwardly directed, restrictive orifice. The tube functions to convey pressurized gas from the annulus lower portion into the production bore.

In use, the bottom of the funnel is preferably positioned close to and above the perforations. Produced water will accumulate in the bottom of the casing bore and will rise to cover the base of the funnel side wall. Gas separates from the water, passes through the annular gap and rises to accumulate as a column in the upper end of the annulus lower portion, extending down from the packer. As gas pressure in the lower portion of the annulus increases, water above the bottom rim of the funnel may be displaced into the production bore, where it joins water and gas that have traveled from the perforations into the production bore. The flow of water and gas passing through the narrowing funnel passageway accelerates, has increasing turbulence and tends to hold contained solids in suspension. Gas under pressure flows from the upper end of the lower portion of annulus, through the tube bore, and is discharged as a jet into the production bore. This gas functions to assist in gas lifting water through the production bore to ground surface. The gas and water rise through the production bore in the form of discrete slugs.

Broadly stated, the invention comprises an apparatus for assisting in producing gas and water to ground surface from a subterranean formation through a flowing well having a tubular production casing string forming a longitudinal bore and having perforations in fluid communication with the formation, comprising: a tubular production tubing string forming a longitudinal bore and extending down the casing string from ground surface; a funnel connected with the lower end of the tubing string, the funnel having a bottom inlet and a longitudinal passageway extending therethrough; the tubing string bore and the funnel passageway combining to form a production bore; the casing and tubing strings forming an annulus therebetween; packer means, mounted on the tubing string above the funnel, for sealing against the casing string to isolate the lower portion of the annulus beneath the packer means from the upper portion of the annulus above the packer means; the tubing string, funnel and packer means combining to form a structural unit; the funnel extending downwardly and outwardly from the lower end of the tubing string to combine with the casing string to form a gap providing a passageway for fluid movement between the lower end of the casing string bore and the annulus lower portion; and conduit means, carried by the structural unit, having an inlet communicating with the upper end of the annulus lower portion and an outlet communicating with the production bore, for conveying pressurized gas from the annulus lower portion into the production bore.

DESCRIPTION OF THE PREFERRED EMBODIMENT

Figure 1:
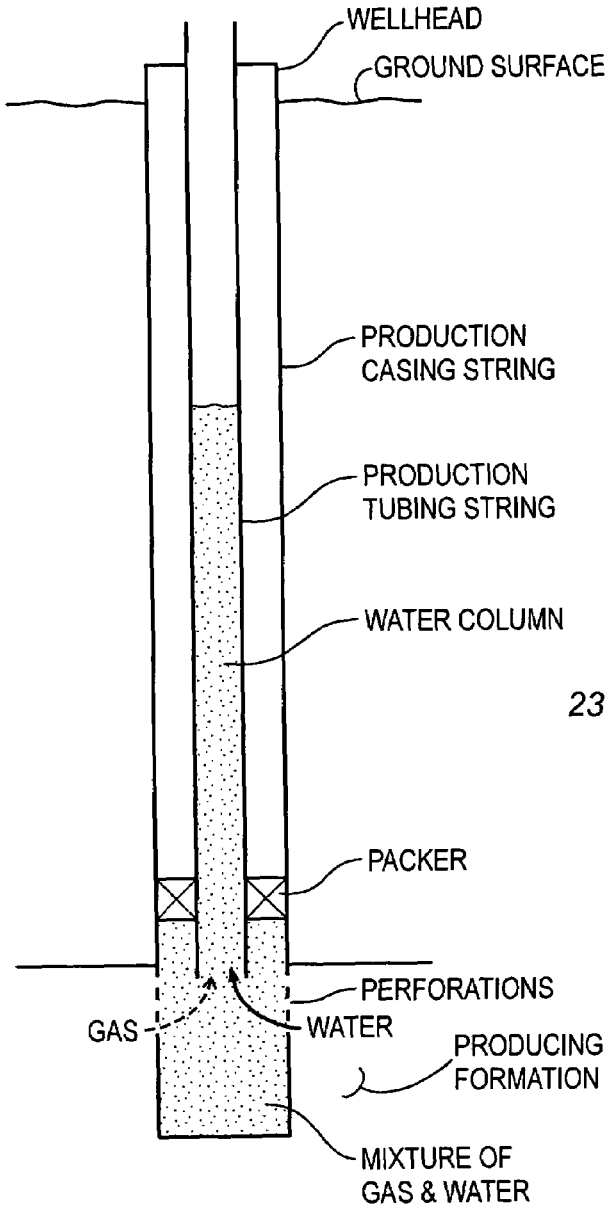
FIG. 1 is a schematic side view, in simplified form, showing a flowing gas well in accordance with the prior art.
Figure 2:
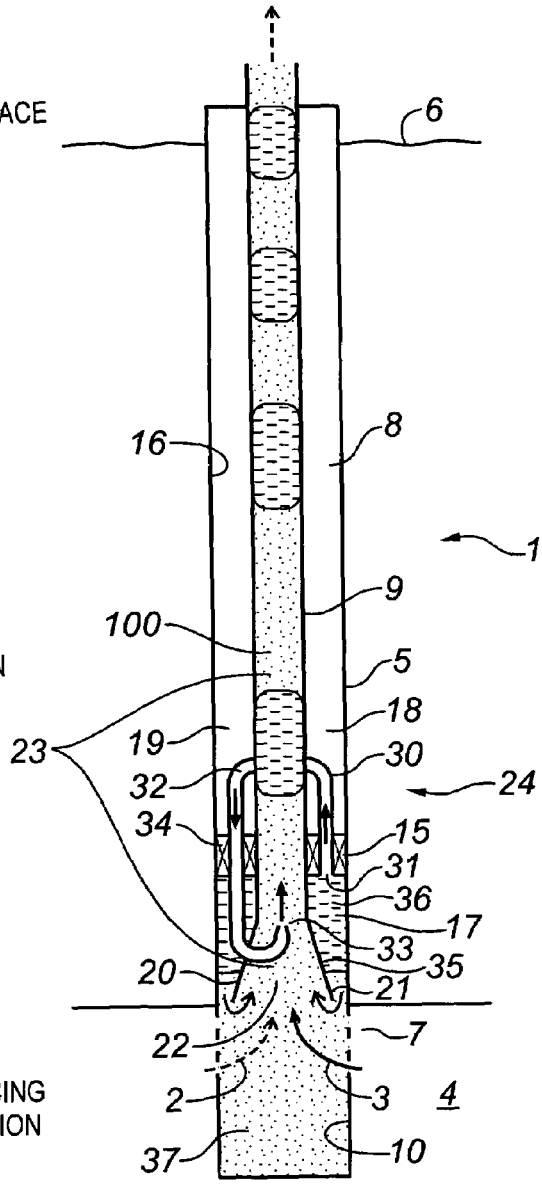
FIG. 2 is a schematic side view similar to FIG. 1, showing a flowing gas well incorporating one embodiment of the present gas lift apparatus.
Figure 3:
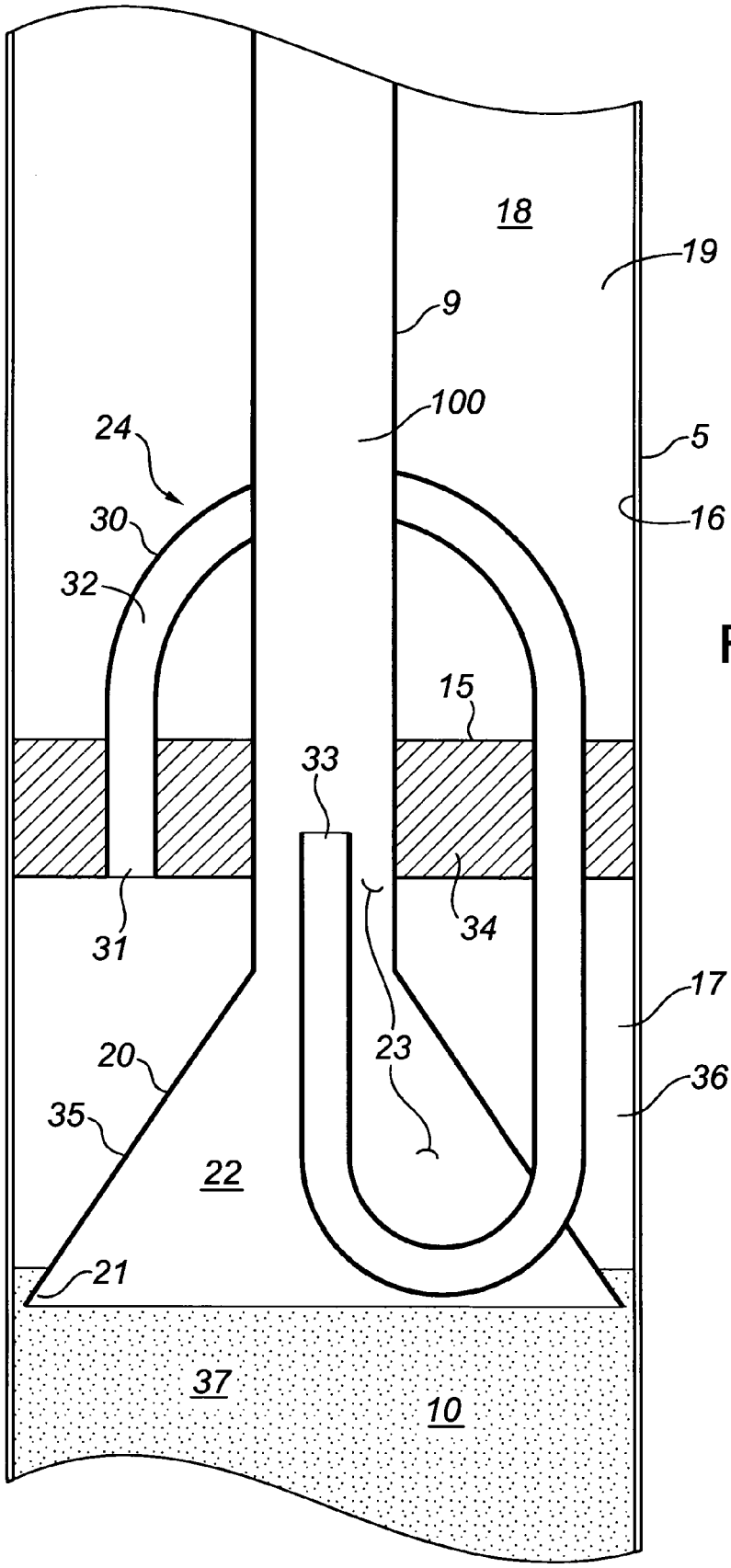
FIG. 3 is an expanded schematic side view of the gas lift assembly of FIG. 2, showing the production casing and tubing strings, a packer, a funnel and a gas transfer tube.

Having reference to FIG. 2, there is provided a conventional flowing gas well 1 for producing gas 2 and salt water 3 from a subterranean formation 4.

A string 5 of production casing extends down from the wellhead 101 at ground surface 6 and penetrates the formation 4. The casing string 5 is perforated across a formation interval by perforations 7, to enable fluids to enter the casing bore 10 from the formation 4.

A string 9 of continuous coil tubing extends down the bore 10 of the casing string 5 from ground surface 6. The tubing string 9 is landed above but close to the perforations 7.

A conventional packer 15, used with continuous coil tubing, is mounted on the lower end of the tubing string 9. The packer 15 seals against the inside surface 16 of the casing string 5 at a point spaced above the perforations 7. The packer 15 isolates the lower portion 17 of the annulus 18, formed between the casing and tubing strings 5, 9, from the upper portion 19 thereof.

A funnel 20 is attached at its upper end to the lower end of the tubing string 9. The funnel 20 widens downwardly, so that its bottom edge 21 is close to but spaced from the inside surface 16 of the casing string 5. The funnel 20 forms an internal longitudinal passageway 22 extending therethrough. The passageway 22 combines with the tubing string bore 100 to form an open-bottomed production bore 23.

The tubing string 9, packer 15 and funnel 20 combine to form a structural unit 24.

A tube 30 is supported by the unit 24. The tube 30 has an inlet 31, a longitudinal bore 32 and an outlet 33. The inlet 31 communicates with the lower portion 17 of the annulus 18, directly beneath the bottom end of the packer 15. The tube outlet 33 communicates with the production bore 23. The outlet 33 preferably is a restrictive orifice. In the specific embodiment shown, the tube 30 extends upwardly through the body 34 of the packer 15, bends through 180°, extends back down through the packer body and through the side wall 35 of the funnel 20 and then bends again, so that its outlet 33 is upwardly directed in the funnel passageway 22.

The assembly of the tubing string 9, packer 15, funnel 20 and tube 30, when positioned within the casing string 5 of a gas well 1, provides an apparatus for producing gas and water.

In operation, gas 2 and water 3 enter the bottom of the casing string bore 10 through the perforations 7. Gas 2 breaks out of the mixture, rises and accumulates as a short column 36 in the lower portion 17 of the annulus 18, directly beneath the packer 15. The mixture of water and gas in the casing string bore 10 forms a column 37 that covers the bottom edge 21 of the funnel 20. Formation pressure drives water and gas up into the production bore 23. As the gas pressure of the annular column 36 builds up, it tends to force water, covering the bottom end of the funnel 20 into the production bore 23. The diminishing cross-section of the funnel passageway 22 tends to accelerate the flow moving therethrough. At the same time, gas from the column 36 moves through the tube bore 32, under pressure, and is discharged as an upwardly directed jet through the outlet 33 into the production bore 23.

Experimental runs with laboratory scale equipment have indicated that conveying gas from the lower portion of the annulus and discharging it as an upwardly directed jet into the production bore, is of assistance in gas lifting water to ground surface through the production bore.

It is anticipated that those skilled in the art can substitute equivalents or variants for the components of the assembly, without significantly altering the manner in which the assembly works. For example, various forms of packer may be used. The funnel may be conical or stepped in configuration. The tube does not need to extend up and back down through the packer—it can have its inlet positioned in the annulus lower portion and extend directly through the funnel side wall into the production bore. The scope of the invention is defined by the claims now following and is intended to cover variants.

The invention claimed is:

1. Apparatus for assisting in producing gas and water to ground surface from a subterranean formation through a flowing well having a tubular production casing string forming a longitudinal bore and having perforations in fluid communication with the formation, comprising:

a tubular production tubing string forming a longitudinal bore and extending down the casing string from ground surface;

a funnel connected with the lower end of the tubing string, the funnel having a bottom inlet and a longitudinal passageway extending therethrough;

the tubing string bore and the funnel passageway combining to form a production bore;

the casing and tubing strings forming an annulus therebetween;

packer means, mounted on the tubing string above the funnel, for sealing against the casing string to isolate the lower portion of the annulus beneath the packer means from the upper portion of the annulus above the packer means;

the tubing string, funnel and packer means combining to form a structural unit;

the funnel extending downwardly and outwardly from the lower end of the tubing string to combine with the casing string to form a gap for providing fluid communication between the lower end of the bore of the casing string with the annulus lower portion; and conduit means, carried by the unit, having an inlet communicating with the upper end of the annulus lower portion and an outlet communicating with the production bore, for conveying pressurized gas from the annulus lower portion into the production bore.

2. The apparatus as set forth in claim 1 comprising:

a restrictive orifice, forming the tube outlet, through which a jet of gas is discharged from the tube.

3. The apparatus as set forth in claim 1 or 2 wherein:

the bottom inlet of the funnel is spaced below the packer.

4. The apparatus as set forth in claim 1 or 2 wherein:

the bottom inlet of the funnel is spaced below the packer; and the outlet of the tube is spaced above the bottom end of the funnel.

5. The apparatus as set forth in claim 1 wherein the conduit means has a restrictive orifice forming its outlet.

6. The apparatus as set forth in claim 5 wherein the outlet is upwardly directed.

7. The apparatus as set forth in claim 1, 5 or 6 wherein the conduit means outlet is positioned within the funnel passageway and above the bottom end of the funnel.

8. The apparatus as set forth in claim 1, 5 or 6 wherein the conduit means is a tube having its outlet positioned within the funnel passageway and above the bottom of the funnel.

9. The apparatus as set forth in claim 1, 5 or 6 wherein the gap is annular.

10. The apparatus as set forth in claim 1, 5 or 6 wherein the gap is annular and the conduit means outlet is positioned within the funnel passageway and above the bottom end of the funnel.

11. The apparatus as set forth in claim 1, 5 or 6 wherein the funnel is conical and the gap is annular.

12. The apparatus as set forth in claim 1, 5 or 6 wherein the funnel is conical, the gap is annular and the conduit means extends through the packer.

* * * * *